United States Patent [19]

Van Gorp

[11] 4,313,550

[45] Feb. 2, 1982

[54] PACKAGE CONTAINING OPTICAL FIBRES MADE OF GLASS AND APPARATUS FOR PACKING GLASS OPTICAL FIBRES

[75] Inventor: Cornelis J. Van Gorp, Eindhoven, Netherlands

[73] Assignee: U.S. Philips Corporation, New York, N.Y.

[21] Appl. No.: 127,693

[22] Filed: Mar. 6, 1980

[30] Foreign Application Priority Data

Sep. 17, 1979 [NL] Netherlands ..... 7906904

[51] Int. Cl.[3] ..... B65H 17/20

[52] U.S. Cl. ..... 226/194; 242/47; 242/170

[58] Field of Search ..... 242/47, 47.01, 47.12, 242/47.13, 170, 174, 159; 226/181, 188, 190, 194; 28/21; 53/430; 206/63.3, 63.5, 388-390

[56] References Cited

U.S. PATENT DOCUMENTS 2,736,512 2/1956 Drummond et al. ..... 242/170

2,854,731 10/1958 Drummond ..... 28/21

FOREIGN PATENT DOCUMENTS 2701650 5/1978 Fed. Rep. of Germany.

*Primary Examiner*—Leonard D. Christian

*Attorney, Agent, or Firm*—Marc D. Schechter

[57] ABSTRACT

Package containing a glass optical fiber and apparatus for packaging glass optical fibres.

A package containing optical fibres, made of glass, consists of two plates between which the optical fiber is wound in a double helix pattern. Such a package is compact and enables unwinding of the optical fibers without stresses. In addition, the optical fiber can be tested for continuity in the package and during unwinding.

The invention further relates to an apparatus for producing such a package.

11 Claims, 4 Drawing Figures

PACKAGE CONTAINING OPTICAL FIBRES MADE OF GLASS AND APPARATUS FOR PACKING GLASS OPTICAL FIBRES

BACKGROUND OF THE INVENTION

The invention relates to a package of and apparatus for packing glass optical fibers.

Packages of optical fibers may be used as an intermediate product during the production of conductive optical fiber cables.

It is known from the German Patent Application No. 2701650 to unwind optical fibers, which were previously coated with a protective layer, from a reel, or to pull them from a holder before working of the glass fiber. Because of the relatively big core, only a limited quantity of optical fiber can be wound on a reel in proportion to the volume of the reel. Feeding the optical fiber into a holder and pulling it out again easily results in torsional stresses and kinks (sharp bends) in the optical fiber, which greatly reduce the optical properties of the optical fibers.

SUMMARY OF THE INVENTION

The invention provides an improved package of optical fibers, which is easily obtainable immediately after drawing and/or coating of the optical fiber before it is made into a cable.

According to the invention, the package optical fibers comprises two plates between which the optical fibers are wound in accordance with a double helix pattern.

In order to fix the optical fibers in the package at least to some extent, one or both of the two plates is preferably provided with a fibrous surface at the side facing the optical fiber. For an optimum utilization of space, the two plates are preferably circular. With the package according to the invention the helices are compressed so that the pitch is substantially equal to the thickness of the optical fiber. The diameter of at least one of the helices is preferably larger than half the diameter of the disk; in this embodiment the possibility that the optical fibers get tangled is then substantially reduced to zero. For the last-mentioned embodiment, in accordance with a preferred embodiment, the thickness of at least the plate on which the optical fibers are located decreases from the edges to the center to compensate for the thickness of the heap of glass fibers, which is thicker in the center.

The invention also relates to an apparatus for packaging optical fibers by means of which package of the above-mentioned type can be obtained. This apparatus comprises a feeder for the optical fibers. This feeder is capable of revolving around a first axis. Possibly, first axis is mounted to be capable of revolving around a second axis. The apparatus also comprises a support for a plate. When the first axis does not revolve around the second axis, the plate is mounted in a rotary manner around a second axis. All axes are arranged vertically, the first axis not being coaxial relative to either second axis. The feeder may consist of a pair of rollers.

The invention is based on the recognition of the fact that a package containing an optical fiber arranged in accordance with a regular pattern between two plates can be easily unwound, free from stress in the optical fiber, and can be obtained in a simple way. In addition, such a package requires little space. An additional advantage is that the optical fiber can be tested for continuity in its package and during unwinding. This is not possible when the optical fiber is packaged "randomly" in a holder, owing to the kinks then occuring.

BRIEF DESCRIPTION OF THE DRAWING

The invention and its advantages will now be explained with reference to the drawing.

DESCRIPTION OF THE PREFERRED EMBODIMENTS

Figure 1A:
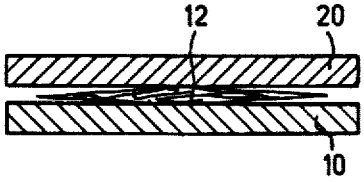
FIG. 1*a* is a schematic cross-sectional view of an embodiment of the package according to the invention.
Figure 1B:
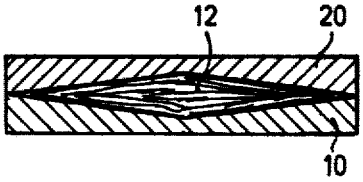
FIG. 1*b* is a schematic, cross-sectional view of a second embodiment of the package according to the invention.

Referring to FIGS. 1*a* and 1*b*, reference numeral 12 denotes a mass of optical fibers which are wound in a double helix pattern. The optical fibers 12 are disposed between two plates 10 and 20. FIG. 1*b* shows a special embodiment wherein, for clarity, it is shown in a highly exaggerated manner that the thickness of the plates 10 and 20 decreases from their edges to their centers to compensate for the greater thickness, in the center of the mass of optical fibers 12.

Figure 2:
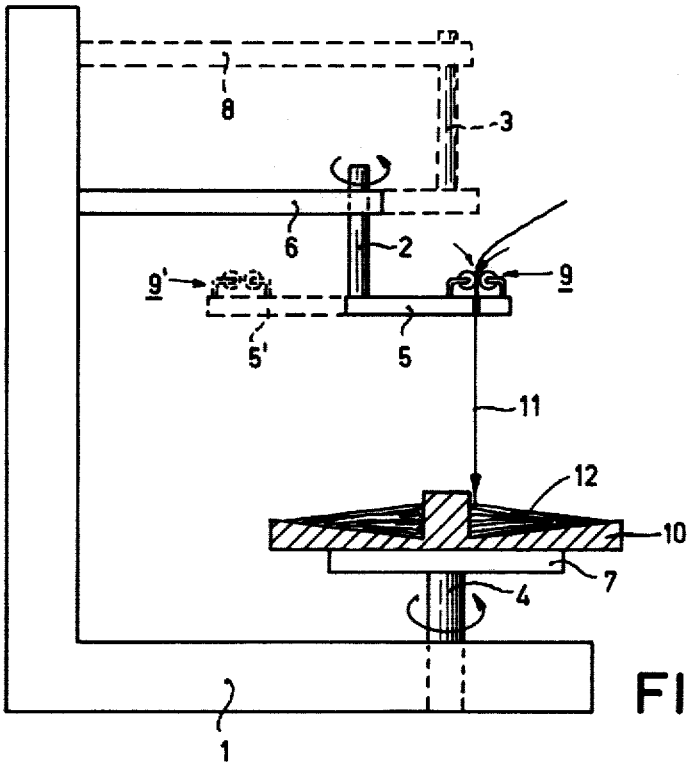
FIG. 2 shows, schematically, a cross-section of an apparatus according to the invention.

The apparatus shown in FIG. 2 is comprised of a frame 1 to which a first axle 2 is attached via an arm 6. A feeder 9 for the optical fiber is attached to axle 2 via an arm 5. In the embodiment shown, the feeder 9 comprises a pair of rollers. References 5' and 9' show, by means of a broken line, the positions of 5 and 9 after 180° rotation around a first axis defined by axle 2.

Alternatively, it is possible to connect axle 2 to the frame via a second axle 3 and an arm 8 (shown in the drawing by means of broken lines). In that event arm 6 is omitted.

Figure 3:
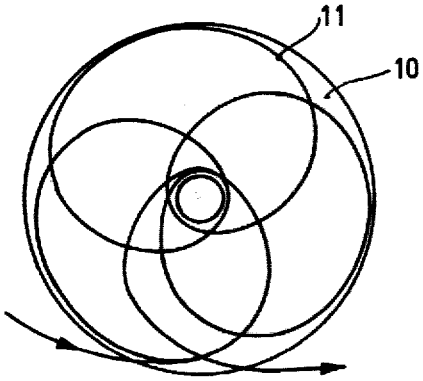
FIG. 3 is an elevational view of plate 10 in FIG. 2.

An axle 4, bearing a support 7 for plate 10 is also attached to the frame. FIG. 3 shows, in elevational view, loading of the optical fiber 11 on plate 10.

When the apparatus shown in FIG. 2 is used, feeder 9 is rotated around axle 2 the first axis defined by optical fiber 11 being simultaneously fed forward. At the same time, axis 2 rotates around a second axis defined by axle 3 or plate 10 rotates around a second axis defined by axle 4. As soon as a sufficient length of optical fiber has been deposited on plate 10, plate 10 is removed from the support and a second plate 20, for example a foam rubber plate is placed on top of the heap of optical fibers 12.

In order to fix the optical fibers on plate 10, the upper surface of plate 10 has, preferably, a fibrous surface area. Plate 10 may consist of several types of material, such as wood, synthetic resin material and metal, a suitable material being foam rubber.

If the optical fiber must be subjected to further operations, plate 20 is first removed from the package. Then the optical fiber is pulled from mass 12. The optical fiber is then obtained stress-free and without kinks (sharp bends).

It is possible to accommodate a length of 5 km of optical fibers (100μm thick) in a layer thickness of only 1 mm on plate 10 when a circular plate 10 having a diameter of 1 m is used. With fluctuations in the ambient temperature, the optical fiber continues to lie flat.

What is claimed is:

1. An apparatus for packaging optical fibers comprising;

a frame;

a plate support mounted on the frame;

a plate mounted on the plate support;

a feeder for feeding optical fiber onto the plate, said feeder being mounted on the frame for revolving around a first axis, said first axis being oriented transverse to the plate; and means for revolving the first axis relative to the plate, said relative revolution being around a second axis which is oriented transverse to the plate but is not coaxial with the first axis.

2. An apparatus as claimed in claim 1, characterized in that the plate is horizontal and the first and second axes are vertical.

3. An apparatus as claimed in claim 2, characterized in that the means for revolving the first axis relative to the plate comprises means for revolving the first axis around the second axis.

4. An apparatus as claimed in claim 2, characterized in that the means for revolving the first axis relative to the plate comprises means for rotating the plate around the second axis.

5. An apparatus as claimed in claim 3 or 4, characterized in that the feeder comprises a pair of rollers.

6. A package of optical fibers comprising two plates between which the optical fibers are wound substantially in a double helix pattern.

7. A package as claimed in claim 6, characterized in that at least one of the plates is provided with a fibrous surface at its side facing the optical fibers.

8. A package as claimed in claim 7, characterized in that the pitch of the helices is equal to the thickness of the optical fiber.

9. A package as claimed in claim 8, characterized in that the plates are circular.

10. A package as claimed in claim 6, 7, 8, or 9 characterized in that the diameter of at least one of the helices exceeds half the diameter of the plate.

11. A package as claimed in claim 10, characterized in that the thickness of at least one plate decreases from the edges to the center.

* * * * *